US011268326B2

(12) United States Patent
Liu et al.

(10) Patent No.: US 11,268,326 B2
(45) Date of Patent: Mar. 8, 2022

(54) MULTI-PATH COMBINED HIGH-LOW VOLTAGE PLASMA DRILLING POWER SOURCE AND DRILLLING SYSTEM

(71) Applicant: China University of Petroleum (East China), Shandong (CN)

(72) Inventors: Yonghong Liu, Shandong (CN); Qiang Sun, Shandong (CN); Qingyun Li, Shandong (CN); Renjie Ji, Shandong (CN); Baoping Cai, Shandong (CN); Xiaopeng Li, Shandong (CN); Yancong Han, Shandong (CN); Hang Dong, Shandong (CN); Xinlei Wu, Shandong (CN); Peng Liu, Shandong (CN); Dege Li, Shandong (CN)

(73) Assignee: China University of Petroleum (East China), Shandong (CN)

( * ) Notice: Subject to any disclaimer, the term of this patent is extended or adjusted under 35 U.S.C. 154(b) by 198 days.

(21) Appl. No.: 16/733,093

(22) Filed: Jan. 2, 2020

(65) Prior Publication Data

US 2020/0217140 A1 Jul. 9, 2020

(30) Foreign Application Priority Data

Jan. 3, 2019 (CN) ..... 2019100031996

(51) Int. Cl.
*E21B 7/15* (2006.01)

(52) U.S. Cl.
CPC ..... *E21B 7/15* (2013.01)

(58) Field of Classification Search
CPC ..... E21B 7/15
See application file for complete search history.

(56) References Cited

U.S. PATENT DOCUMENTS

2009/0050371 A1* 2/2009 Moeny ..... E21B 10/00 175/57
2018/0209216 A1* 7/2018 Gilbrech ..... E21B 7/15

FOREIGN PATENT DOCUMENTS

| | | | |
|---|---|---|---|
| CN | 201303435 | Y | 9/2009 |
| CN | 201491363 | U | 5/2010 |
| CN | 201878036 | U | 6/2011 |
| CN | 107634661 | A | 1/2013 |
| CN | 204179961 | U | 2/2015 |

* cited by examiner

*Primary Examiner* — Dany E Akakpo
(74) *Attorney, Agent, or Firm* — IP & T Group LLP

(57) ABSTRACT

An embodiment of the present disclosure provides a multi-path combined high-low voltage plasma drilling power source and drilling system. The multi-path combined high-low voltage plasma drilling power source comprises a high-voltage DC circuit, low-voltage DC circuits, high-voltage breakdown modules and an upper computer; wherein the high-voltage DC circuit is connected with the low-voltage DC circuits through cables; the low-voltage DC circuits and the high-voltage breakdown modules simultaneously supply power to plasma generators through cables; the upper computer monitors the low-voltage DC circuits in real time; and the same power source comprises a plurality of low-voltage DC circuits and high-voltage breakdown modules.

6 Claims, 3 Drawing Sheets

MULTI-PATH COMBINED HIGH-LOW VOLTAGE PLASMA DRILLING POWER SOURCE AND DRILLLING SYSTEM

The present application claims priority under 35 U.S.C. § 119(a) to Chinese Patent Application No. 2019100031996, filed on Jan. 3, 2019, the disclosure of which is incorporated herein by reference in its entirety.

BACKGROUND

Technical Field

The present application belongs to the field of oil engineering, and in particular relates to a multi-path combined high-low voltage plasma drilling power source and a drilling system.

Description of the Related Art

Plasma drilling technology is an emerging drilling technology with the advantages of fast drilling speed, high rock breaking efficiency and no loss of drill bit. It is expected to become a new generation of drilling technology. At present, the plasma drilling technology is mainly divided into two types: high-voltage pulsed plasma drilling technology and plasma arc ablation drilling technology. In the high-voltage pulsed plasma drilling technology, rocks are broken through the pulse discharge between the positive and negative electrodes at the front end of the drill bit, and thus this technology has the disadvantages of high energy consumption and unstable operation. In the plasma arc ablation drilling technology, rocks are melt using high temperature generated by a high-power plasma generator at the front end of the drill bit, and thus this technology has the disadvantages of small borehole and short life span of the drill bit.

The original single-path plasma arc ablation rock-breaking method is changed into multi-path combined high-low pressure plasma rock-breaking method by combining the advantages of the high-voltage pulse plasma drilling technology and the plasma arc ablation drilling technology, such that the drilling power can be greatly improved, the drilling speed is increased, the life span of drilling tools is prolonged, and application and development of the plasma drilling technology are promoted. The traditional plasma drilling power source cannot be applied to multi-path combined high-low voltage plasma drilling process due to small output power, single output, no pulse function or online adjustment function. Therefore, it is necessary to develop a new high-power plasma drilling power source.

BRIEF SUMMARY

To overcome the deficiencies of the prior art, the present disclosure provides a multi-path combined high-low voltage plasma drilling power source and a drilling system.

According to a first aspect, an embodiment of the present disclosure provides a multi-channel combined high-low voltage plasma drilling power source, comprising a high-voltage direct current (DC) circuit, low-voltage DC circuits, high-voltage breakdown modules and an upper computer; wherein the high-voltage DC circuit is connected with low-voltage DC circuits through cables; the low-voltage DC circuits and the high-voltage breakdown modules simultaneously supply power to plasma generators through cables; the upper computer monitors the low-voltage DC circuits in real time; and the same power source comprises a plurality of low-voltage DC circuits and high-voltage breakdown modules.

In an embodiment of the present disclosure, the high-voltage DC circuit comprises a rectifier circuit and a power factor correction circuit; three-phase alternating current is transmitted to the rectifier circuit in the high-voltage DC circuit, and is rectified into high-voltage direct current which is then transmitted to the power factor correction circuit for power factor correction through a cable; and the corrected high-voltage direct current is transmitted to the low-voltage DC circuits through cables.

In an embodiment of the present disclosure, the low-voltage DC circuit comprises an inverter circuit, a transformer circuit, a secondary rectifier circuit, a current detection circuit, and a PWM control circuit; the high-voltage direct current is transmitted to the inverter circuit of the low-voltage DC circuit through a cable by the high-voltage DC circuit; the inverter circuit inverts the high-voltage direct current into high-frequency alternating current according to a control command sent by the PWM control circuit; the inverted high-frequency alternating current is transmitted to the transformer circuit through a cable; the transformer circuit transmits the transformed high-frequency alternating current to the secondary rectifier circuit through a cable; the secondary rectifier circuit transmits the rectified low-voltage direct current to a plasma generator through a cable; the current detection circuit collects current signal in the plasma generator and transmits it to the upper computer; the upper computer transmits a control signal to the PWM control circuit on the basis of processing the received current signal; and the PWM control circuit adjusts the duty ratio of an inverter signal according to the received signals from the upper computer and the inverter circuit, thereby enabling the inverter circuit to output a suitable high-frequency alternating current.

According to a second aspect, an embodiment of the present disclosure provides a multi-channel combined high-low voltage plasma drilling system, comprising a drill bit apparatus and a combined high-low voltage pulse power source, wherein the drill bit apparatus comprises a drill bit and a driving device, wherein a plurality of plasma generators are disposed on the drilling surface of the drill bit, and the driving device is linked with the drill bit for driving the drill bit to rotate reciprocally in the range of 360°; the combined high-low voltage pulse power source comprises a high-voltage direct current (DC) circuit, a plurality of low-voltage DC circuits, a plurality of high-voltage breakdown modules and an upper computer, wherein the number of the low-voltage DC circuits and that of the high-voltage breakdown modules are both the same as that of the plasma generators; the high-voltage DC circuit is electrically connected to the low-voltage DC circuits for transmitting high-voltage direct current to the low-voltage DC circuits; the low-voltage DC circuits and the high-voltage breakdown modules are both electrically connected to the plasma generators for jointly supplying power to the plasma generators; and the upper computer monitors the low-voltage DC circuits in real time, and controls the low-voltage DC circuits to supply power to the plasma generators.

In an embodiment of the present disclosure, the system further includes a drilling fluid supply apparatus configured to release the drilling fluid towards the bottom of the drilling well so as to cool the plasma generators after releasing the plasma arc.

Correspondingly, drilling fluid outlets are disposed on the drilling surface of the drill bit to be in communication with the drilling fluid supply apparatus.

In an embodiment of the present disclosure, a center-position plasma generator is disposed at a central position of the drilling surface of the drill bit; and a plurality of side-position plasma generators are disposed on the drilling surface by way of outward radiation centering on the central position, and each of the center-position plasma generator and the side-position plasma generators is electrically connected to the corresponding low-voltage DC circuit and high-voltage breakdown module.

In an embodiment of the present disclosure, the drilling fluid outlets are disposed around the plasma generators.

In an embodiment of the present disclosure, the high-voltage DC circuit comprises a rectifier circuit and a power factor correction circuit, wherein: the rectifier circuit is configured to rectify three-phase alternating current transmitted into high-voltage direct circuit; and the power factor correction circuit is configured to perform power factor correction on the high-voltage direct current transmitted and to transmit the corrected high-voltage direct current to the low-voltage DC circuits.

In an embodiment of the present disclosure, the low-voltage DC circuit comprises an inverter circuit, a transformer circuit, a secondary rectifier circuit, a current detection circuit and a PWM control circuit, wherein: the inverter circuit is configured to invert the high-voltage direct current into high-frequency alternating current according to a control command sent by the PWM control circuit; the transformer circuit is configured to perform transformation processing on the high-frequency alternating current; the secondary rectifying circuit is configured to perform secondary rectification on the transformed high-frequency alternating current, and transmit the rectified low-voltage direct current to the plasma generator; the current detection circuit is configured to collect current signal in the plasma generator and transmits it to the upper computer, such that the upper computer transmits a control signal to the PWM control circuit after processing the received current signal; and the PWM control circuit is configured to adjust the duty ratio of an inverter signal according to the received control signal and send a control command to the inverter circuit to enable the inverter circuit to output a suitable high-frequency alternating current.

The multi-path combined high-low voltage plasma drilling power source and the drilling system provided by the embodiments of the present disclosure perform multi-path control on the plurality of plasma generators during the drilling operation, so that a plurality of paths simultaneously operate in parallel and do not interfere with each other, and the purposes of large total power of circuits and high drilling efficiency are achieved.

BRIEF DESCRIPTION OF THE DRAWINGS

In order to more clearly illustrate the technical solutions disclosed in the embodiments of the present disclosure or the prior art, the drawings used in the descriptions of the embodiments or the prior art will be briefly described below. Obviously, the drawings in the following description are only certain embodiments of the present disclosure, and other drawings can be obtained according to these drawings without any creative work for those skilled in the art.

DETAILED DESCRIPTION

In order to make the object, technical solutions and advantages of the embodiments of the present disclosure more clear, the technical solutions in the embodiments of the present disclosure are clearly and completely described below in conjunction with the accompanying drawings in the embodiments of the present disclosure. Obviously, the described embodiments are part of the embodiments of the present disclosure, and not all of the embodiments. All other embodiments obtained by a person of ordinary skill in the art based on the embodiments of the present disclosure without any creative work belong to the scope of the present disclosure.

Figure 1:
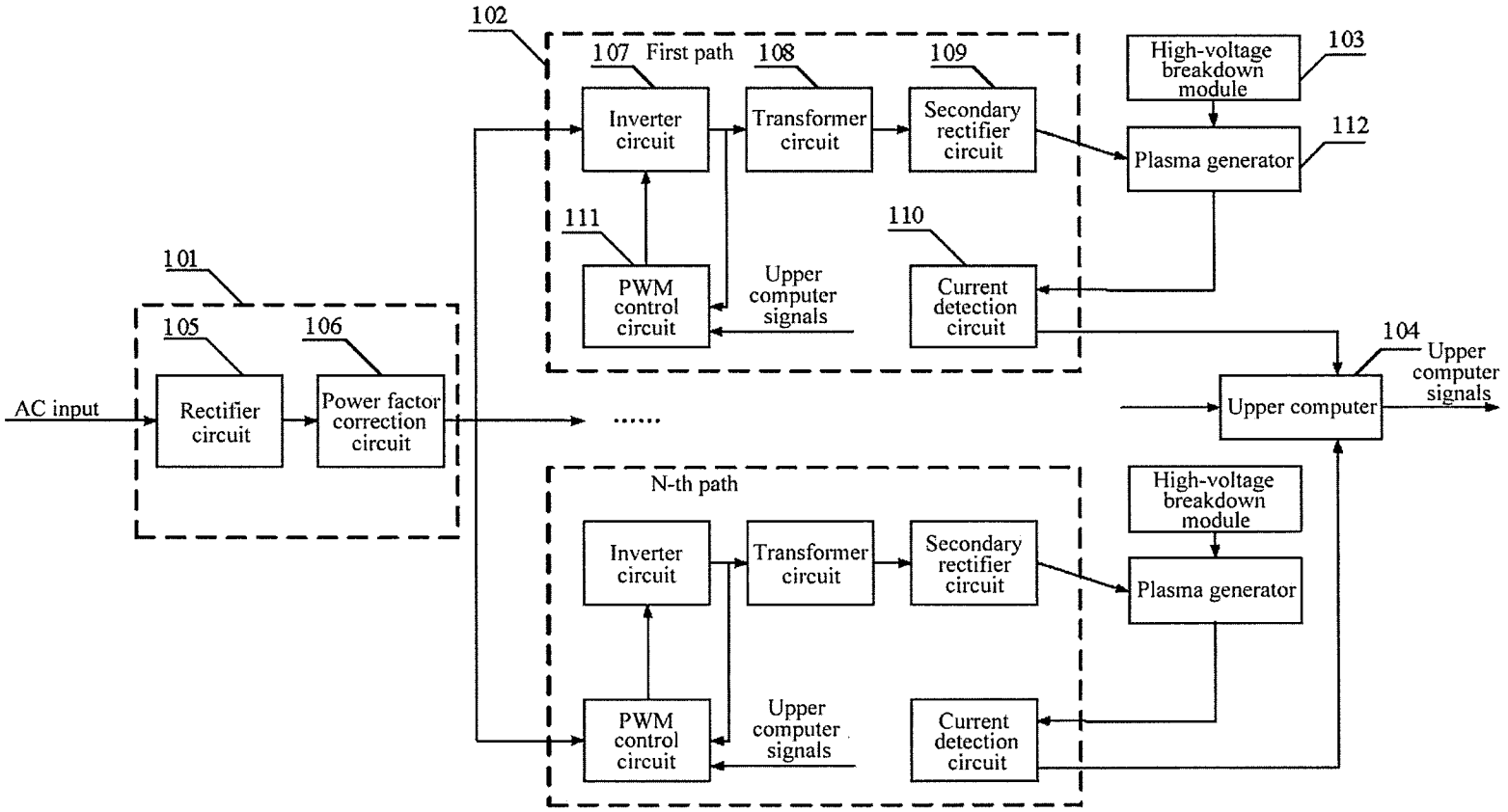
FIG. 1 is a block diagram showing components of a multi-path combined high-low voltage plasma drilling power source according to an embodiment of the present disclosure.

FIG. 1 shows a block diagram of components of a multi-path combined high-low voltage plasma drilling power source according to an embodiment of the present disclosure. As can be seen from FIG. 1, the multi-path combined high-low voltage plasma drilling power source according to the embodiment of the present disclosure includes a high-voltage direct current (DC) circuit 101, low-voltage DC circuits 102, high-voltage breakdown modules 103, and an upper computer 104; wherein the high-voltage DC circuit 101 is connected with the low-voltage DC circuits 102 through cables; the low-voltage DC circuits 102 and high-voltage breakdown modules 103 simultaneously supply power to plasma generators 112 through cables; the upper computer 104 monitors the low-voltage DC circuits 102 in real time; the high-voltage DC circuit 101 includes a rectifier circuit 105 and a power factor correction circuit 106; each of the low-voltage DC circuits 102 includes an inverter circuit 107, a transformer circuit 108, a secondary rectifier circuit 109, a current detection circuit 110, and a PWM control circuit 111; the same power source includes a plurality of low-voltage DC circuits 102 and high-voltage breakdown modules 103; three-phase alternating current is transmitted to the rectifier circuit 105 in the high-voltage DC circuit 101 and rectified into high-voltage direct current which is then transmitted to the power factor correction circuit 106 for power factor correction through a cable; the corrected high-voltage direct current is transmitted to the inverter circuit 107 through a cable, and the inverter circuit 107 inverts the high-voltage direct current into high-frequency alternating current according to a control command sent by the PWM control circuit 111; the inverted high-frequency alternating current is transmitted to the transformer circuit 108 through a cable; the transformer circuit 108 transmits the transformed high-frequency alternating current to the secondary rectifier circuit 109 through a cable; the secondary rectifier circuit 109 transmits the rectified low-voltage direct current to a plasma generator 112 through a cable; a high-voltage pulse signal generated by the high-voltage breakdown module 103 is transmitted to the plasma generator 112 through a coaxial cable; the current detection circuit 110 collects current signal in the plasma generator 112 and transmits it to the upper computer 104; the upper computer 104 transmits a control signal to the PWM control circuit 111 on the basis of processing the received current signal; and the PWM control circuit 111 adjusts the duty ratio of an inverter signal according to the received signals from the upper computer 104 and the inverter circuit 107, thereby enabling the inverter circuit 107 to output a suitable high-frequency alternating current.

Figure 2:
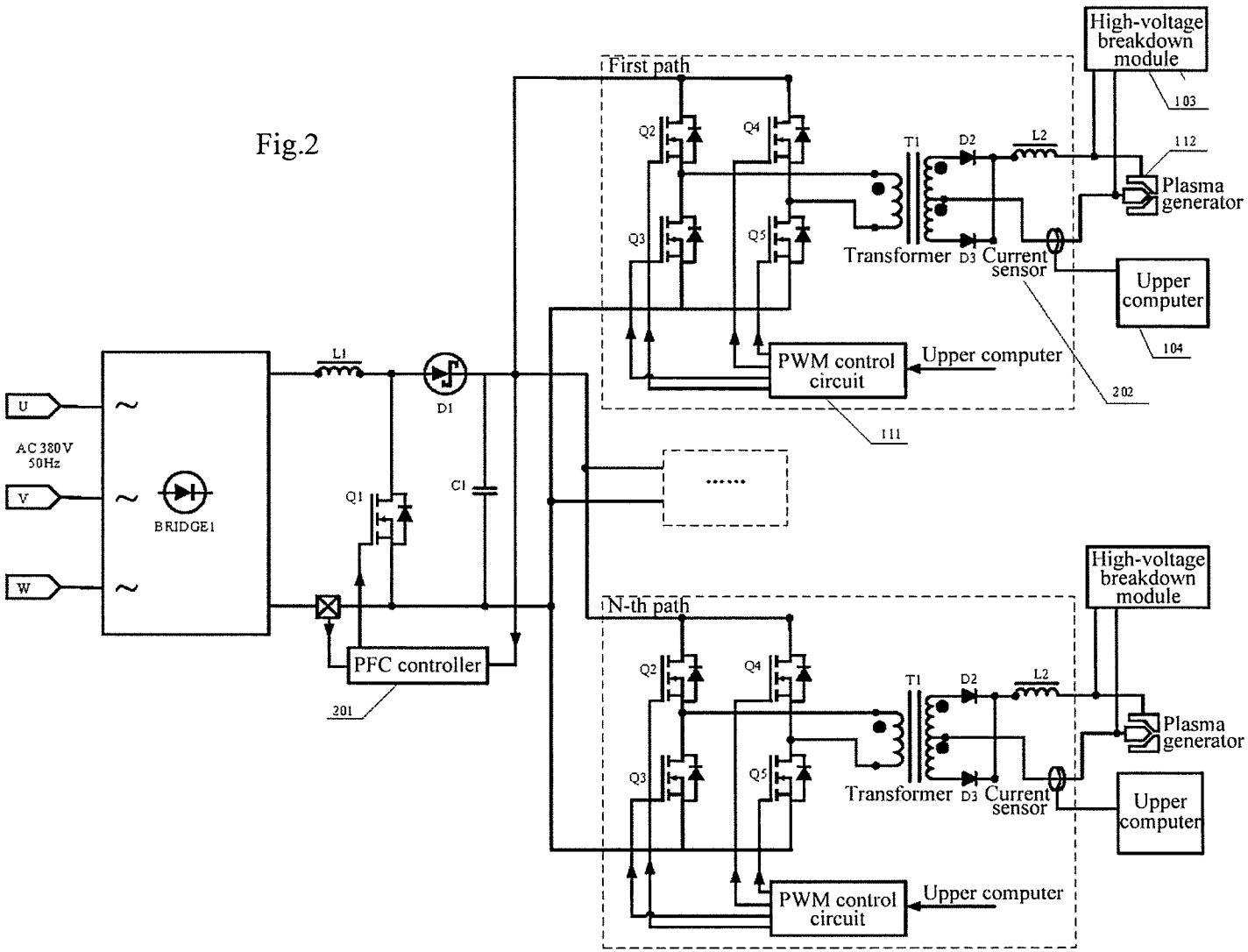
FIG. 2 is a circuit configuration diagram of the multi-path combined high-low voltage plasma drilling power source according to an embodiment of the present disclosure.

FIG. 2 shows a circuit configuration diagram of the multi-path combined high-low voltage plasma drilling power source according to an embodiment of the present disclosure. As can be seen from FIG. 2, in the circuits of the multi-path combined high-low voltage plasma drilling power source of the present disclosure, three-phase rectifier bridge BRIDGE1 constitutes the rectifier circuit 105, which rectifies the input three-phase alternating current into the high-voltage direct current being transmitted to the power factor correction circuit 106 through a cable; an inductor L1, a power switching element Q1, a diode D1, a capacitor C1 and a PFC controller 201 constitute the power factor correction circuit 106 for performing the power factor correction on the direct current rectified by the rectifier circuit 105, to reduce harmonic pollution to the power grid; the power switching elements Q2, Q3, Q4, Q5 constitute a full-bridge inverter, and the full-bridge inverter generates high-frequency alternating current under the control signal from the PWM control circuit 111; the high-frequency alternating current is delivered to the primary side of a high-frequency pulse transformer T1 through a cable, high-frequency AC square wave with the same frequency and phase and reduced amplitude is generated at the secondary side of the high-frequency pulse transformer T1 and delivered to a full-wave rectifier circuit composed of D2 and D3, the full-wave rectifier circuit converts the high-frequency AC square wave into high-frequency DC square wave and transmits it to the inductor L2 to become a low-voltage direct current; the low-voltage direct current is transmitted to the plasma generator 112 through a cable; a high-voltage pulse signal generated by the high-voltage breakdown module 103 is transmitted to the plasma generator 112 through a coaxial cable, and then the plasma generator 112 operates; Hall current sensor 202 constitutes the current detection circuit 110, which collects the current signal of the plasma generator 112 and transmits it to the upper computer 104; and the PFC controller 201 varies the input current as the change of the input voltage by controlling the turn-on and turn-off of the power switching element Q1 thereby improving the power factor.

Figure 3:
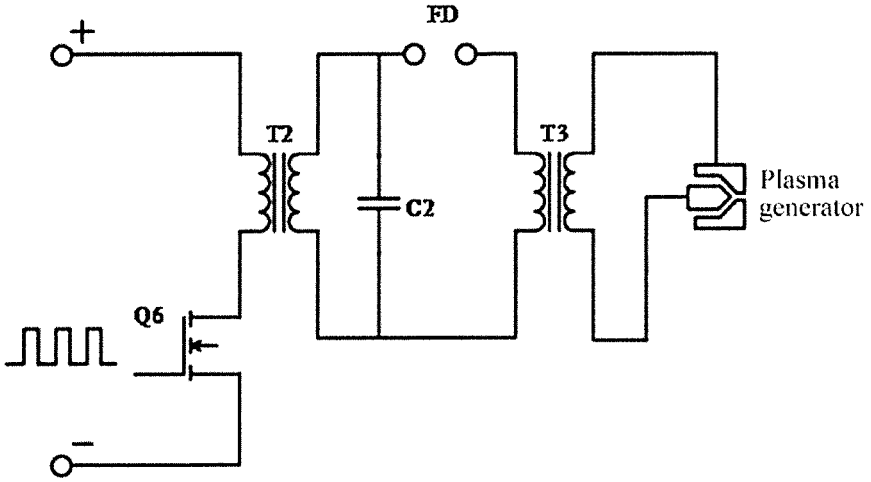
FIG. 3 is a schematic structural diagram of a high-voltage breakdown module of the multi-path combined high-low voltage plasma drilling power source according to an embodiment of the present disclosure.

FIG. 3 shows a schematic structural diagram of a high-voltage breakdown module of the multi-path combined high-low voltage plasma drilling power source according to an embodiment of the present disclosure. As can be seen from FIG. 3, the high-voltage breakdown module 103 of the multi-path combined high-low voltage plasma power source of the present disclosure comprises a power switching element Q6, pulse transformers T2 and T3, a capacitor C2, a spark discharger FD; 24V direct current supplies power to the entire circuit; and the control circuit provides a high-frequency pulse signal to the power switching element Q6 to control the turn-on and turn-off of the power switching element Q6, and high-frequency pulse current is generated on the primary side of the pulse transformer T2; after passing through the primary coil of the pulse transformer T2, the high-frequency pulse current is boosted into high-voltage high-frequency pulse current which charges the capacitor C2, and electric quantity accumulated on the capacitor C2 cannot be released through an effective loop since an air gap is present between the two ends of the spark discharger FD so that the capacitor is always charged; the air gap between the two ends of the FD is broken when the voltage value across the capacitor C2 reaches the breakdown voltage of the spark discharger FD, the spark discharger discharges to form a loop; the capacitor C2, an equivalent resistance R formed by the breakdown of the air gap in the spark discharger FD and an inductance L of the primary coil of the transformer T3 constitute an RLC oscillating circuit, which generates high-frequency high-voltage signals; the voltage signals are applied to two ends of the electrodes of the plasma generator 112 after being boosted by the pulse transformer T3 to ionize and break down air therebetween, thereby forming a plasma channel to achieve high-voltage breakdown.

The multi-path combined high-low voltage plasma drilling power source provided by the embodiments of the present disclosure performs multi-path control on the plurality of plasma generators during the drilling operation, so that a plurality of paths are operated simultaneously in parallel and do not interfere with each other, and the purposes of large total power of circuits and high drilling efficiency are achieved.

An embodiment of the present disclosure provides a multi-path combined high-low voltage plasma drilling system, comprising a drill bit apparatus and a combined high-low voltage pulse power source, wherein the drill bit apparatus is electrically connected with the combined high-low voltage pulse power source, the combined high-low voltage pulse power source provides power to the drill bit apparatus for drilling operation.

Figure 4:
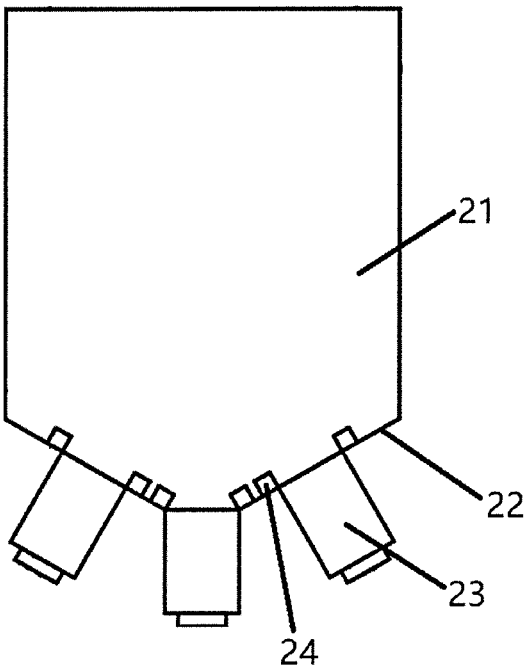
FIG. 4 is a schematic structural diagram of a drill bit according to an embodiment of the present disclosure.

The drill bit apparatus according the embodiment of the present disclosure employs a plasma rock-breaking method, so the drill bit apparatus includes a drill bit and a driving device. FIG. 4 shows a schematic structural diagram of a drill bit according to an embodiment of the present disclosure. A plurality of plasma generators 23 are disposed on the drilling surface 22 of the drill bit 21, and the driving device is linked with the drill bit for driving the drill bit to rotate reciprocally in the range of 360° at the bottom area of the drilling well, thereby performing rock-breaking operation from multiple angles on the bottom of the drilling well at a relatively large bottom area and achieving the purpose of high utilization efficiency of the drilling energy.

In a further embodiment of the drilling system according to the embodiment of the present disclosure, the system further includes a drilling fluid supply apparatus configured to release the drilling fluid towards the bottom of the drilling well so as to cool the plasma generators after releasing the plasma arc.

Correspondingly, in a further embodiment of the drill bit according to the embodiment of the present disclosure, drilling fluid outlets 24 are disposed on the drilling surface 22 of the drill bit 21, and configured to be in communication with the drilling fluid supply apparatus and uniformly discharge the drilling fluid released by the drilling fluid supply apparatus around the plasma generators at the bottom of the drilling well. In an embodiment of the present disclosure, the drilling fluid outlets are disposed around the plasma generators.

In a further embodiment of the drilling bit according to the embodiment of the present disclosure, a center-position plasma generator is disposed at a central position of the drilling surface 22 of the drill bit 21. A plurality of side-position plasma generators are disposed on the drilling surface by way of outward radiation centering on the central position, and each of the center-position plasma generator and the side-position plasma generators is electrically connected to the corresponding low-voltage DC circuit and high-voltage breakdown module.

In the embodiment according to the present disclosure, as shown in FIG. 1 above, the combined high-low voltage pulse power source includes a high-voltage DC circuit 101, a plurality of low-voltage DC circuits 102, a plurality of high-voltage breakdown modules 103, and an upper computer 104. In order to achieve multi-path combined high-low voltage plasma drilling, the number of the low-voltage DC circuits and that of high-voltage breakdown modules are both the same as that of the plasma generators.

The high-voltage DC circuit 101 is electrically connected to the low-voltage DC circuits 102 for transmitting high-voltage direct current to the low-voltage DC circuits.

The low-voltage DC circuits 102 and the high-voltage breakdown modules 103 are electrically connected to the plasma generators 112 for jointly supplying power to the plasma generators.

The upper computer 104 monitors the low-voltage DC circuits 102 in real time, and controls the low-voltage DC circuits to supply power to the plasma generators.

In a further embodiment of the combined high-low voltage pulse power source according to the embodiment of the present disclosure, as shown in FIG. 1, the high-voltage DC circuit 101 includes a rectifier circuit 105 and a power factor correction circuit 106, wherein: the rectifier circuit 105 is configured to rectify three-phase alternating current transmitted into high-voltage direct circuit; and the power factor correction circuit 106 is configured to perform power factor correction on the high-voltage direct current transmitted and to transmit the corrected high-voltage direct current to the low-voltage DC circuits.

Each low-voltage DC circuit 102 comprises an inverter circuit 107, a transformer circuit 108, a secondary rectifier circuit 109, a current detection circuit 110 and a PWM control circuit 111, wherein: the inverter circuit 107 is configured to invert the high-voltage direct current into high-frequency alternating current according to a control command sent by the PWM control circuit; the transformer circuit 108 is configured to perform transformation processing on the high-frequency alternating current; the secondary rectifying circuit 109 is configured to perform secondary rectification on the transformed high-frequency alternating current, and transmit the rectified low-voltage direct current to the plasma generator; the current detection circuit 110 is configured to collect current signal in the plasma generator and transmits it to the upper computer, such that the upper computer transmits a control signal to the PWM control circuit after processing the received current signal; and the PWM control circuit 111 is configured to adjust the duty ratio of an inverter signal according to the received control signal and send a control command to the inverter circuit to enable the inverter circuit to output a suitable high-frequency alternating current.

When the multi-path combined high-low voltage plasma drilling method is performed, the drill bit rotates at the bottom of a drilling well, and a plurality of combined high-low voltage pulse power sources control the corresponding plasma generators respectively during the rotation process, so that the plasma generators emit high-frequency pulsed plasma arcs to break rocks on the wall of the drilling well.

In the process that the plasma generators emit high-frequency pulsed plasma arcs, a drilling fluid supply apparatus releases drilling fluid to the bottom of the drilling well through the drilling fluid outlets.

According to the embodiment of the present disclosure, by disposing the plurality of plasma generators and making each plasma generator have an independent combined high-low voltage pulse power source to provide energy, it is not necessary to design a power source with large power, the electrode loss of the drill bit is reduced, the rock-breaking operation can be performed from multiple angles at a large bottom area of the drilling well, and the high drilling energy utilization rate is achieved. In addition, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

Through the description of the embodiments above, those skilled in the art can clearly understand that the various embodiments can be implemented by means of software and a necessary general hardware platform, and of course, by hardware. Based on such understanding, the above-mentioned technical solutions in essence or a part thereof that contributes to the prior art, may be embodied in the form of a software product, which may be stored in a computer-readable storage medium such as ROM/RAM, magnetic Discs, optical discs, etc., including several instructions to cause a computer device (which may be a personal computer, server, or network device, etc.) to perform various embodiments or the methods described by part of the various embodiments.

Finally, it should be noted that the above embodiments are only used to explain the technical solutions of the present disclosure, and are not limited thereto; although the present disclosure is described in detail with reference to the foregoing embodiments, it should be understood by those skilled in the art that they can still modify the technical solutions described in the foregoing embodiments and make equivalent replacements to a part of the technical features therein; and these modifications and replacements do not depart from the spirit and scope of the technical solutions of the embodiments of the present disclosure.

The invention claimed is:

1. A multi-path combined high-low voltage plasma drilling system, comprising a drill bit apparatus and a combined high-low voltage pulse power source, wherein:

the drill bit apparatus comprises a drill bit and a driving device, wherein a plurality of plasma generators are disposed on a drilling surface of the drill bit, and the driving device is linked with the drill bit for driving the drill bit to rotate reciprocally in the range of 360°;

the combined high-low voltage pulse power source includes a high-voltage DC circuit, a plurality of low-voltage DC circuits, a plurality of high-voltage breakdown modules and an upper computer, wherein the number of the low-voltage DC circuits and that of the high-voltage breakdown modules are both the same as that of the plasma generators;

the high-voltage DC circuit is electrically connected to the low-voltage DC circuits for transmitting high-voltage direct current to the low-voltage DC circuits;

the low-voltage DC circuits and the high-voltage breakdown modules are electrically connected to the plasma generators for jointly supplying power to the plasma generators; and the upper computer monitors the low-voltage DC circuits in real time, and controls the low-voltage DC circuits to supply power to the plasma generators.

2. The multi-path combined high-low voltage plasma drilling system of claim 1, further comprising a drilling fluid supply apparatus configured to release drilling fluid towards a bottom of a drilling well to cool the plasma generators which have emitted plasma arcs;

correspondingly, drilling fluid outlets are disposed on the drilling surface of the drill bit to be in communication with the drilling fluid supply apparatus.

3. The multi-path combined high-low voltage plasma drilling system of claim 2, wherein a center-position plasma generator is disposed at a central position of the drilling surface of the drill bit; and a plurality of side-position plasma generators are disposed on the drilling surface by way of outward radiation centering on the central position, and each of the center-position plasma generator and the side-position plasma generator is electrically connected to a corresponding low-voltage DC circuit and the high-voltage breakdown module.

4. The multi-path combined high-low voltage plasma drilling system of claim 3, wherein the drilling fluid outlets are disposed around the plasma generators.

5. The multi-path combined high-low voltage plasma drilling system of claim 4, wherein the high-voltage DC circuit comprises a rectifier circuit and a power factor correction circuit, wherein:

the rectifier circuit is configured to rectify three-phase alternating current transmitted into high-voltage direct circuit; and the power factor correction circuit is configured to perform power factor correction on the high-voltage direct current transmitted and to transmit the power factor corrected high-voltage direct current to the low-voltage DC circuits.

6. The multi-path combined high-low voltage plasma drilling system of claim 5, wherein the high-voltage DC circuit comprises an inverter circuit, a transformer circuit, a secondary rectifier circuit, a current detection circuit and a pulse width modulation (PWM) control circuit, wherein:

the inverter circuit is configured to invert the high-voltage direct current into high-frequency alternating current according to a control command sent by the PWM control circuit;

the transformer circuit is configured to perform transformation processing on the high-frequency alternating current;

the secondary rectifying circuit is configured to perform secondary rectification on the transformed high-frequency alternating current, and transmit a rectified low-voltage direct current a plasma generator of the plurality of plasma generators;

the current detection circuit is configured to collect current signal in the plasma generator of the plurality of plasma generators and transmit the current signal to the upper computer, such that the upper computer transmits a control signal to the PWM control circuit after processing the current signal; and the PWM control circuit is configured to adjust a duty ratio of an inverter signal according to the control signal and send a control command to the inverter circuit to enable the inverter circuit to output a suitable high-frequency alternating current.

* * * * *